United States Patent [19]

Heiden et al.

[11] Patent Number: 4,517,773

[45] Date of Patent: May 21, 1985

[54] DRIVABLE WHEEL FOR THE FINISH GRINDING OR POLISHING OF THE SURFACE OF A VEHICLE BODY OR THE LIKE

[75] Inventors: Ulrich Heiden, Munich; Peter Atzler, Altomunster, both of Fed. Rep. of Germany

[73] Assignee: Bayerische Motoren Werke A.G., Fed. Rep. of Germany

[21] Appl. No.: 441,683

[22] Filed: Nov. 15, 1982

[30] Foreign Application Priority Data

Nov. 13, 1981 [DE] Fed. Rep. of Germany ..... 3145151

[51] Int. Cl.[3] ..... B24B 9/02

[52] U.S. Cl. ..... 51/336; 51/334

[58] Field of Search ..... 51/330, 331, 332, 334, 51/336, 337, 338, 339

[56] References Cited

FOREIGN PATENT DOCUMENTS 3047877 7/1982 Fed. Rep. of Germany ..... 51/336

*Primary Examiner*—Frederick R. Schmidt
*Assistant Examiner*—J. T. Zatarga
*Attorney, Agent, or Firm*—Craig & Burns

[57] ABSTRACT

This invention relates to a drivable wheel for the finish grinding or polishing of the surfaces of a vehicle body. The wheel includes a mounting shaft fashioned as a hollow shaft, which shaft is equipped, on the one hand, with a holding flange and, on the other hand, with an outer thread to which can be threaded an ejector sleeve provided on its externally located end face with a holding flange. A supporting sleeve is rotatably disposed on this ejector sleeve and is equipped with twenty-four axially parallel mounting slots. Radially projecting grinding elements provided with lateral extensions and being of respectively equal length are inserted in these mounting slots, the extensions, for the attachment of the grinding elements, being covered by axial projections extending from the holding flanges.

16 Claims, 2 Drawing Figures

DRIVABLE WHEEL FOR THE FINISH GRINDING OR POLISHING OF THE SURFACE OF A VEHICLE BODY OR THE LIKE

TECHNICAL FIELD

This invention relates to a drivable wheel for the finish grinding or polishing of a vehicle body or the like.

BACKGROUND OF THE INVENTION

In a conventional grinding wheel, the grinding elements, including individual grinding blades, exhibit an acute-angled extension on their marginal zone on the wheel side, this extension projecting away from the two end edges of the grinding elements. The grinding elements are inserted and clamped in the mounting slots of the mounting sleeve integrally formed at the holding flange, which mounting slots include longitudinal slits; the holding flanges, carried by a mounting shaft, are urged against the extensions by means of a threaded connection. Because the grinding elements are customarily also equipped with abrasive grains on the end faces of the extensions, these are somewhat pressed, that is, "interlocked", by pressure, into the facing surface of the holding flanges; and because grinding elements having several grinding blades, after being clamped in place, can also be urged against the two broadsides of the mounting slots. The grinding blades are pressed into these mounting slots whereby the grinding elements must be removed from the mounting slots respectively individually for purposes of exchange, after releasing the threaded connection. Due to the relatively brief lifetime of grinding elements, this is very time-consuming and therefore uneconomical, especially in assembly-line grinding of vehicle bodies.

SUMMARY AND OBJECTS OF THE INVENTION

It is, therefore, an object of the invention to fashion a grinding wheel generally of the type discussed hereinabove in such a way that the grinding elements can be exchanged rapidly and without complications.

This object has been attained according to this invention by providing that at least one ejector is associated with the grinding elements, by way of which the grinding elements can be displaced radially toward the outside.

Besides avoiding the disadvantages of the prior art, an ejector as provided according to this invention considerably improves the manufacturing procedure during the grinding step. Moreover, by coupling ejectors and holding flange, the ejectors can be displaced radially outwardly by the mere release of a holding flange.

These and other objects, features and advantages of the present invention will become more apparent from the following description when taken in connection with the accompanying drawing which shows, for purposes of illustration only, one embodiment in accordance with the present invention, and wherein

DETAILED DESCRIPTION OF THE PREFERRED EMBODIMENTS

Figure 1:
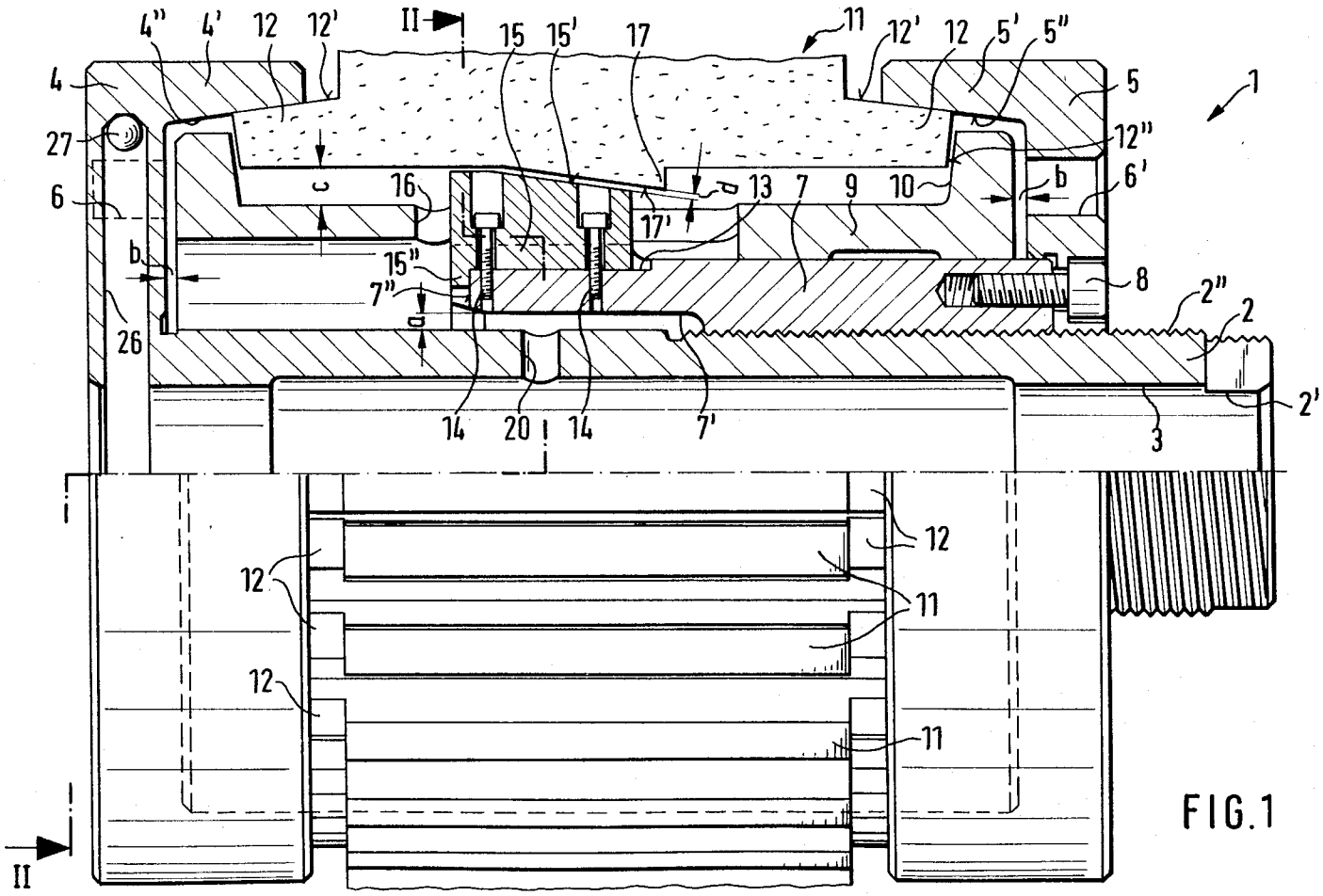
FIG. 1 shows a grinding wheel in a front view, one-half in a cross-sectional illustration.
Figure 2:
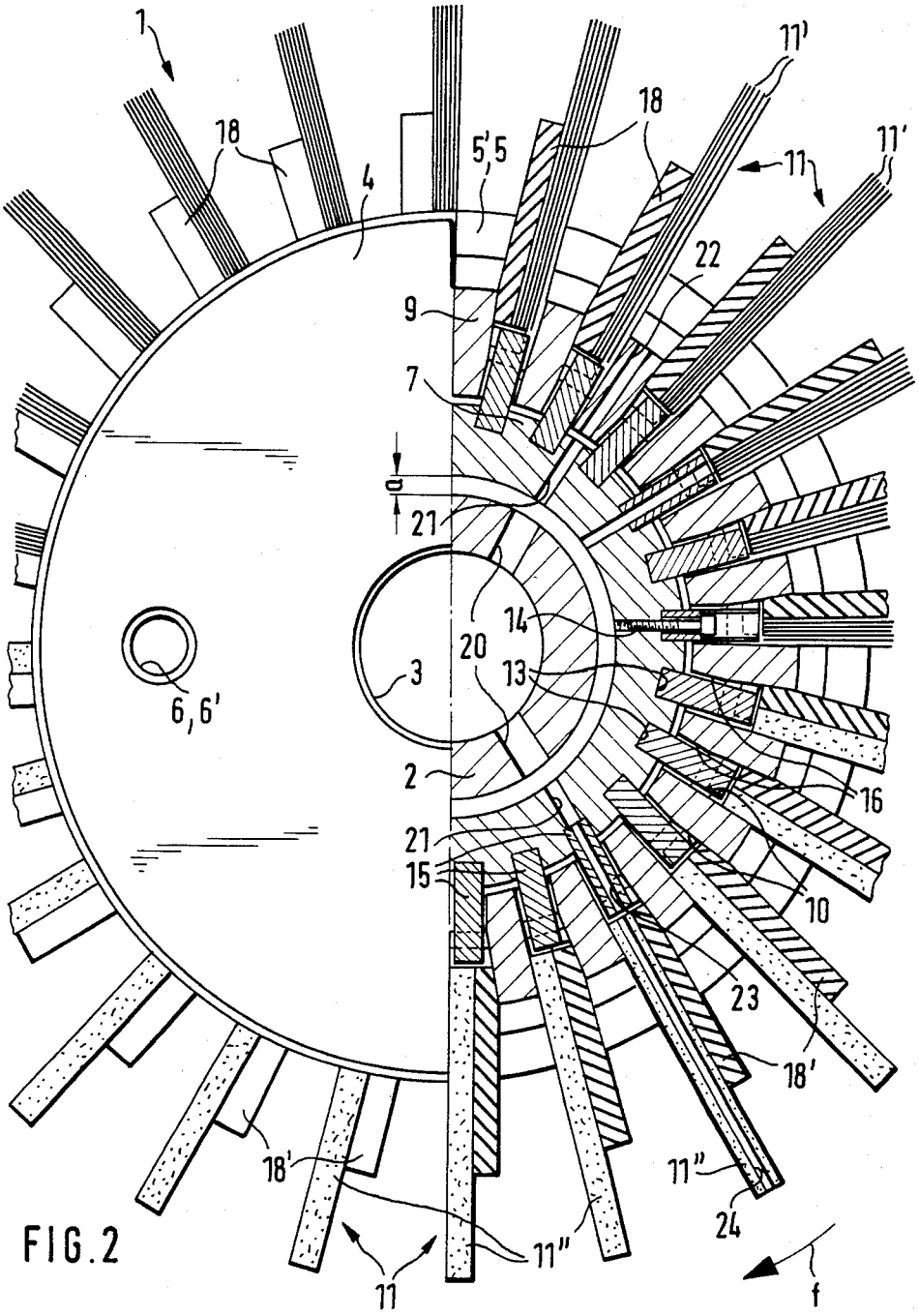
FIG. 2 shows a section along line II-II in FIG. 1, rotated by 90°.

Referring now to the drawings wherein like reference numerals are used throughout the various views to designate like parts, wheel 1, illustrated in FIG. 1 and FIG. 2 serves for the finish grinding or polishing of an untreated or treated, that is, paint-coated, surface of a vehicle body or the like. Wheel 1 is installed in a horizontal, vertical, or inclined spatial position into a device and is driven by way of a drive mechanism, not shown. Wheel 1 and the vehicle body are in relative motion with respect to each other. In this arrangement, the grinding elements 11 of wheel 1 are urged with a high contact pressure against the workpiece surface to be machined.

As can be seen from FIG. 1, wheel 1 includes a mounting shaft 2 designed as a hollow shaft. This shaft has a central longitudinal bore 3, as well as a cross slot 2' or a similar rotating means at its free end face. A holding flange 4 is integrally formed at an end section of the mounting shaft 2. An axial projection 4' extends from the externally located marginal zone of this flange and is oriented toward the opposed end of the mounting shaft 2. The mounting shaft 2 can be rotated about its longitudinal axis and/or can be secured against torsional rotation by means of a bore 6 provided at the end face side at the holding flange 4. Likewise, the holding flange 4 can also be provided with flattened portions or the like. The mounting shaft 2 is furthermore equipped with an outer thread 2'' extending from its free end to the zone of its longitudinal line of symmetry and serving as a drive thread. An ejector sleeve 7 exhibiting a corresponding internal thread is threaded onto this outer thread. The internal thread extending up approximately its longitudinal line of symmetry while an axially extending recess 7' adjoins the internal thread. The diameter of this recess is larger than the outer diameter of the mounting shaft 2, so that an annular slot a is formed. A holding flange 5 is threaded by means of several screws 8 to the externally disposed end face of the ejector sleeve 2. An axial projection 5' extends from the externally located marginal zone of this flange and faces the axial projection 4'. By means of a bore 6' or bevels or the like provided at the holding flange 5 arranged at the end face of the holding flange 5, the latter can be rotated together with the ejector sleeve 7 about the axis of rotation and/or these parts can be secured against rotation.

A supporting sleeve 9 is supported so to be rotatable and axially displaceable on the ejector sleeve 7. The longitudinal extension of this supporting sleeve is dimensioned so that, with the grinding elements 11 being mounted in place, an axial clearance b is respectively created between its end faces and the facing end faces of the holding flanges 4 and 5. The supporting sleeve 9 also includes a plurality, e.g. twenty-four axially parallel mounting slots 10. They are arranged at uniform or nonuniform angular spacings with respect to each other. In top view, these mounting slots have a rectangular shape or are rounded along their narrow sides and extend, with the formation of a narrow rim, into the close proximity of the two end faces of the supporting sleeve 9. All of the walls of the mounting slots 10 extend in each case obliquely toward the outside, that is, forming an obtuse angle with the base of the mounting slots 10. By grinding elements 11 arranged at nonuniform angular spacings, the repetition of grinding patterns is advantageously avoided during the finish grinding of a workpiece surface. The width of the mounting slots 10 is dimensioned in such a way that radially projecting grinding elements 11, respectively being of equally long longitudinal extensions, can be inserted with their marginal zone on the wheel side in these slots. In order to fix the grinding elements 11 against radial displacement—no matter whether they are individual grinding blades 11' or include an integral grinding member 11''—respectively one extension 12 projects from their two end faces at the marginal zone on the wheel side. The top edge of this extension, serving as an abutment shoulder 12', forms an obtuse angle of about 100° with the adjoining end face of the grinding elements 11. The abutment shoulders 12' of the two extensions 12 of the grinding elements 11 are covered, in their mounted condition, by the largest part by the axial projections 4' and 5' of the holding flanges 4 and 5. In the fixedly clamped condition thereof, the grinding elements 11 are urged with a firm seating into the mounting slots 10. The internally located surface 4'', 5'' of the axial projections 4', 5', cooperating with the abutment shoulder 12' of the projections 12, has the same angle of conicity as the abutment shoulder 12'. Furthermore, the end face 12'' of the extensions 12 forms an obtuse angle with the lower edge of the grinding elements 11, corresponding to the inclined position of the facing narrow side of the rectangular mounting slots 10.

The ejector sleeve 7 is provided at its free end section opposed to the holding flange 5 with axially parallel longitudinal slots 13 respectively associated with a mounting slot 10 provided in the supporting sleeve 9, that is, corresponding to their number as well as to their angularly displaced arrangement as shown in FIG. 2. Respectively, one ejector 15, threaded by way of two screws 14 to the ejector sleeve 7, is inserted in the longitudinal slots 13. The rearward flank 15' of which extends obliquely downwardly. The ejectors 15 have the lowest vertical extension on their end faces, which face the holding flange 5. Furthermore, the rearward flank 15' of the ejectors 15 can have a rounded portion as seen in frontal view, advantageous for the mounting and dismounting of the grinding elements 11 during cooperation with the ejector lugs 17. The radius of such rounded portion corresponds approximately to the distance form the center of the mounting shaft 2 to the rearward flank 15'. In order to fix the ejectors 15 always exactly in place, respectively, one downwardly extending stop lug 15'' is formed at their end faces facing the holding flange 4. This lug contacts a shoulder 7'' of the ejector sleeve 7 located at the end face. The supporting sleeve 9 is provided with passage grooves 16 in its longitudinal central zone. These grooves are about twice as long as the ejectors 15 and somewhat broader than the latter. With the grinding elements 11 being mounted in place, a clearance is respectively provided between the end faces of the ejectors 15 and the end faces of the passage grooves 16.

At each mounting slot 10, respectively one ejector lug 17 is arranged on the underside of the grinding elements 11. The rearward flank 17' of this lug projects obliquely away from the lower edge of the grinding elements 11 and has an angle corresponding to the associated, oblique angle of the rearward flank 15' of the ejectors 15. The vertical dimension of the ejectors 15 at their forward, maximally high-positioned corner edge, is such, with grinding elements 11 being all around in flush contact with the peripheral walls of the mounting slots 10, that a spacing c exists between the lower edge of these grinding elements and the base of the mounting slots 10, that is, the grinding elements 11, in the mounted condition, are carried by the ejectors 15. In this connection, a spacing d also exists between the mutually facing rearward flanks 15' and 17' of ejector 15 and ejector lug 17.

As shown in the upper cross-sectional half of FIG. 2, the individual grinding blades 11' can rest, in the direction of rotation f of the wheel 1, respectively against a supporting blade 18 made of a rubber-elastic material and exhibiting, as compared with the radial extension of the grinding blades 11', a shorter radial extension. This supporting blade is embedded in between the grinding blades 11' or—as shown in the drawing—is clamped in between the broadside of the mounting slots 10 which is rearward in the direction of rotation f of the wheel and the grinding blades 11'.

According to an embodiment which is not illustrated, it is also possible to provide supporting blades having such a thickness on their zone projecting past the circumference of the supporting sleeve 9 that they contact—in the direction of rotation f of the wheel 1—the front side of the respectively rearwardly disposed grinding element 11. By fashioning supporting blades in such a way, a deflecting of the grinding blades 11' is extensively prevented. The supporting blades 18 reduce deflecting of the grinding elements 11 while the wheel 1 is in operation, so that the grinding elements 11 are urged with a higher frictional coefficient against the workpiece surface to be machined. In this connection, the flexural stiffness of the supporting blades 18 can be further enhanced by means of a wedge-shaped configuration tapering toward the free end of the blades and extending along their radial extension. The grinding members 11'' can each be supported against a supporting blade 18' of a metallic or rubber-elastic material having a very high flexural stiffness and embedded into the grinding elements 11. Furthermore, the supporting blades 18', as illustrated in the drawing, can also be clamped—in the same way as the supporting blades 18—in between the rearward broadside of the mounting slots 10 and the grinding members 11''.

For the wet grinding of a workpiece surface by means of the wheel 1, the mounting shaft 2, the ejector sleeve 7 and the supporting sleeve 9 are each equipped with several passage bores 20, 21, 22. Furthermore, at least one passage bore 23 and/or 24 is provided in several ejectors 15 and in several one-piece grinding members 11''. Such bore penetrates in each case the vertical extension of such components. The passage bores 20, 21, 23, and 24 are in fluid communication with one another so that a flowing medium introduced into the central longitudinal bore 3 of the mounting shaft 2—wherein the mounting shaft 2 is sealed fluid-tight as its two end faces in the region of the longitudinal bore 3—passes from the longitudinal bore 3 of the mounting shaft 2, traversing the annular gap a, to the free exit of the passage bores 22, 23, and 24, because the flowing medium during operation of the wheel 1 is effectively conducted toward the outside by centrifugal force. Because grinding elements 11 fashioned as grinding blades 11' as well as one-piece grinding members 11'' are urged, after clamping the holding flanges 4 and 5 into place, into the mounting slots 10 in the radial direction, they are mounted fluid-tight because of the obliquely outwardly extending walls of these slots, so that with the wheel 1 being in rotation, no fluid medium can escape along these walls.

For cleaning a finished machined workpiece surface, it is also possible to provide a rinsing medium, including water with a cleansing agent exhibiting a high wetting power, by means of passage bores 22, provided in uniform distribution in the supporting sleeve 9, the accumulation of ground-off particles on the wheel 1 is also thereby prevented. An overground workpiece surface, or such a surface to be ground over by means of the wheel 1, can also be cleaned by dry grinding, namely by the introduction of compressed air into the longitudinal bore 3 of the mounting shaft 2, or by the mere intaking of air during rotation of the wheel 1 into this bore. Thus, the dust particles are removed from the workpiece surface by air deflected from the outer circumference of the wheel 1 and conducted with acceleration by centrifugal force toward the outside.

The weight of the twenty-four grinding elements 11 arranged at the wheel 1 can be substantially different. Thus, imbalance can be created thereby, as well as due to nonuniform wear on the grinding elements 11. While the wheel 1 is rotating, the wheel 1 is equipped with a balancing device automatically effective during its operation. This device comprises an annular, continuously extending groove 26 formed in the holding flange 4, and a rotatable counterweight, such as one or several balls 27 or similar roller elements, being inserted in this groove. With the wheel 1 being in rotation, the balls 27 arrange themselves automatically in diametrical opposition from the excess mass in the circumferential groove 26 and thereby form a counterweight.

The grinding elements 11 are mounted and dismounted as follows:

(a) Dismounting

With a suitably horizontally disposed wheel 1, the clamping connection existing in the mounted condition of the grinding elements 11 between the latter and the axial projections 4' and 5' of the holding flanges 4 and 5 is released by a torsional rotation of, for example, the holding flange 5 by means of an auxiliary tool (not shown) inserted in the bore 6' in the counterclockwise direction while simultaneously securing the mounting shaft 2 against torsional turning. An auxiliary tool (not shown) is inserted in the bore 6 or in the cross slot 2'. During this procedure, an annular gap is formed between the abutment shoulders 12' of the extensions 12 projecting from the grinding elements 11 and the interiorly located wall surface 4'', 5'' of the axial projections 4', 5'. Because the mounting sleeve 7 is likewise simultaneously removed by threading during this step, the distance d existing between the mutually facing rearward flanks 15' and 17' of ejectors 15 and ejector lugs 17 shrinks. This distance is dimensioned so that, after a further rotation of the holding flange 4 or 5, the rearward flanks 15' of the ejectors 15 contact the rear flanks 17' of the ejector lugs 17. Thereafter, further rotations of the holding flanges 4 and/or 5, the grinding elements 11 together with the supporting blades 18, 18' are pressed out of the mounting slots 10. The rear flank 17' of the ejector lugs 17 has such an inclined position with respect to the lower edge of the grinding elements 11 that, with further threaded release of the holding flanges 4, 5, the grinding elements 11 and the supporting blades 18, 18' are lifted by the ejectors 15 to the largest part out of the mounting slots 10, but leaving in all cases a small annular gap between the abutment shoulders 12' of the extensions 12 and the interiorly positioned wall surfaces 4'', 5'' of the axial projections 4', 5'. This annular gap ensures rotation of the holding flanges 4, 5. Because, as mentioned above, the grinding elements 11 and supporting blades 18, 18' are lifted by the ejectors 15 out of the mounting slots 10 during the unthreading of the holding flanges 4, 5, the grinding elements 11 can be removed from the slots—immediately after they have been entirely released by the axial projections 4', 5' of the holding flanges 4, 5—in a time-saving fashion, or they drop automatically out of the mounting slots 10 so that the feature of equipping the wheel 1 with the grinding elements 11 and the supporting blades 18, 18' is a very economical arrangement.

(b) Assembly

With the mounting slots 10 of the supporting sleeve 9 being uncovered, the grinding elements 11 are mounted in the reverse order as described above. The grinding elements 11 are inserted—with the wheel 1 being suitably perpendicular—together with the supporting blades 18, 18' in the mounting slots 10—the ejector lugs 17 resting on the ejectors 15—and the ejector sleeve 7 with the holding flange 5 is threaded onto the outer thread 2'' of the mounting shaft 2. Finally, the holding flanges 4 and 5 are tightened against each other, the axial projections 4', 5' of these flanges covering the extensions 12 of the grinding elements 11. In this procedure, the ejectors 15 are in the position shown in FIG. 1.

While we have shown and described one embodiment in accordance with the present invention, it is understood that the same is not limited thereto but is susceptible of numerous changes and modifications as known to those skilled in the art, and we therefore do not wish to be limited to the details shown and described herein, but intend to cover all such changes and modifications as are encompassed by the scope of the appended claims.

We claim:

1. A drivable wheel for finish grinding or polishing the surface of a vehicle body or the like, comprising a mounting shaft with a plurality of spaced-apart flanges, one of said plurality of flanges being displaceable in an axial direction relative to another of said plurality of flanges, supporting sleeve means having a peripherally disposed plurality of axially parallel mounting slots for mounting a plurality of radially projecting grinding elements coaxially encompassing the mounting shaft and extending between the plurality of flanges, a plurality of radially projecting grinding elements positioned relative to said mounting shaft by said plurality of flanges, and at least one ejector means operatively connected to said one of said plurality of flanges for displacing the plurality of grinding elements radially outwardly when said one of said plurality of flanges is displaced axially away from said another of said plurality of flanges.

2. The wheel according to claim 1, wherein said at least one ejector means includes an ejector for each grinding element of said plurality of radially projecting grinding elements.

3. The wheel according to claim 2, wherein all of the ejectors for the plurality grinding elements operate simultaneously when said one of said plurality of flanges is axially displaced away from said another of said plurality of flanges.

4. The wheel according to claim 2, wherein each ejector is disposed beneath a respective grinding element and displaced along with said one of said plurality of flanges for acting against an underside of a respective grinding element.

5. The wheel according to claim 2, wherein the mounting shaft includes at one end section an outer thread serving as a driving thread, an ejector sleeve means threadedly engaged onto the outer thread for positioning of said one of said plurality of flanges, said ejector sleeve means having a number of longitudinal slots therein, each of the longitudinal slots being associated respectively with one of the mounting slots provided in the supporting sleeve means, each ejector being attached to the ejector sleeve means and inserted in a respective one of the longitudinal slots, each ejector cooperates with a respective ejector lug projecting from an underside of a respective grinding element and extending obliquely toward the axially displaceable flange, said another flange being fixed relative to the mounting shaft, turning means disposed in said one of said plurality of flanges for imparting rotational forces thereto.

6. The wheel according to claim 5, wherein the mounting slots provided in the supporting sleeve means are rectangular in top view and are open toward the top, the mounting slots extending into close proximity to both end faces of the supporting sleeve means.

7. The wheel according to claim 5, wherein the supporting sleeve means is supported on the ejector sleeve means, said plurality of grinding elements being mounted with an axially oriented clearance between facing end sides of the supporting sleeve means and the plurality of flanges, a plurality of passage grooves in the central zone of the longitudinal extension of the supporting sleeve means serving as a pass-through for each respective ejector.

8. The wheel according to claim 5, wherein each ejector lug respectively provided on the underside of each of the plurality of grinding elements includes a rear flank projecting obliquely away from a lower edge of the respective grinding element, said rear flank exhibiting an angle corresponding to an inclined angle of a rear flank of a respective ejector, the vertical dimension of each ejector being dimensioned so that, with the plurality of grinding elements being mounted, each grinding element is supported with the formation of a spacing between a lower edge of the grinding element and a base of a respective mounting slot, a spacing likewise being provided between the mutually facing rear flanks of each respective ejector and ejector lug of the respective grinding element.

9. The wheel according to claim 5, wherein the mounting slots and the longitudinal slots are arranged at a nonuniform angular spacing with respect to one another.

10. A finishing wheel having a supporting and ejecting arrangement for a plurality of radially outwardly extending grinding elements comprising a plurality of outwardly extending grinding elements, a mounting shaft having a plurality of flange means for positioning the plurality of grinding elements relative to the shaft, one of said plurality of flange means being axially displaceable relative to another of said plurality of flange means along said shaft, supporting sleeve means having a plurality of mounting means for mounting said plurality of grinding elements, and ejector sleeve means operatively displaceable along said shaft with said one of said plurality of flange means for ejecting said plurality of grinding elements from said mounting means of said supporting sleeve means.

11. The finishing wheel as set forth in claim 10, wherein said ejector sleeve means includes a plurality of ejectors attached thereto corresponding in number to the number of said plurality of grinding elements.

12. The finishing wheel as set forth in claim 11, wherein said ejector sleeve means is threadedly engaged coaxially on said shaft means.

13. The finishing wheel as set forth in claim 10, wherein said shaft means is hollow.

14. The finishing wheel as set forth in claim 13, wherein said finishing wheel includes passage bores communicating with said hollow shaft.

15. The finishing wheel as set forth in claim 10, wherein said finishing wheel includes means for balancing said finishing wheel during rotation of said finishing wheel.

16. The finishing wheel as set forth in claim 15, wherein said means for balancing includes a rotatable counterweight.

* * * * *